United States Patent [19]

Perkins

[11] Patent Number: 4,501,231

[45] Date of Patent: Feb. 26, 1985

[54] HEATING SYSTEM WITH LIQUID PRE-HEATING

[76] Inventor: Eugene W. Perkins, Dawsonville, Ga. 31742

[21] Appl. No.: 500,346

[22] Filed: Jun. 2, 1983

[51] Int. Cl.[3] ..... F22B 3/06

[52] U.S. Cl. ..... 122/26; 126/247; 237/1 R

[58] Field of Search ..... 237/1 R, 12.3 R; 126/247; 122/26

[56] References Cited

U.S. PATENT DOCUMENTS 4,143,639 3/1979 Frenette ..... 126/247

4,277,020 7/1981 Grener ..... 126/247

*Primary Examiner*—Henry Bennett

*Attorney, Agent, or Firm*—Scrivener Clarke Scrivener & Johnson

[57] ABSTRACT

A heating system is provided in which a rotor is rotated within a body of liquid within a chamber to heat the liquid by friction, and the liquid is conveyed to a heat exchanger and then returned to the liquid heater. The rotor chamber of the liquid heater is surrounded by a jacket chamber to which cooled liquid passes from the heat exchanger and in which it is heated by convection from the rotor chamber and from which it passes to the rotor chamber.

2 Claims, 2 Drawing Figures

HEATING SYSTEM WITH LIQUID PRE-HEATING

SUMMARY OF THE INVENTION

A heating system which may be portable or installed, for example in a residence or other building, utilizes as the source of heat a liquid heater comprising a chamber filled with a liquid in which a body is rotated to create friction in the liquid, which is then supplied to a heat exchanger external to the liquid heater through a circulation system. Direct introduction of the cooled liquid from the heat exchanger causes a thermal impact on the liquid with reduction in efficiency of the system, and this thermal impact is reduced by supplying the cooled liquid from the heat exchanger to a jacket surrounding the liquid heater before introduction of the liquid into the heating chamber of the liquid heater.

BACKGROUND OF THE INVENTION

While liquid heaters per ses of the described type have been described in many patents and in the literature, no heating system, whether protable or installed, utilizing such a liquid heater as the source of heat has been developed or used. Among the many reasons for this is the observed fact that the cooled liquid returned from the heat exchanger to the liquid heater produces a thermal impact on the liquid in the heater reducing the heating effect on the liquid within the heater and therefore the overall efficiency of the system. The object of the invention has therefore been to provide means for reducing the thermal impact and therefore increasing the efficiency of the system, and this is accomplished by the invention.

DESCRIPTION OF THE PREFERRED EMBODIMENT OF THE INVENTION

Figure 2:
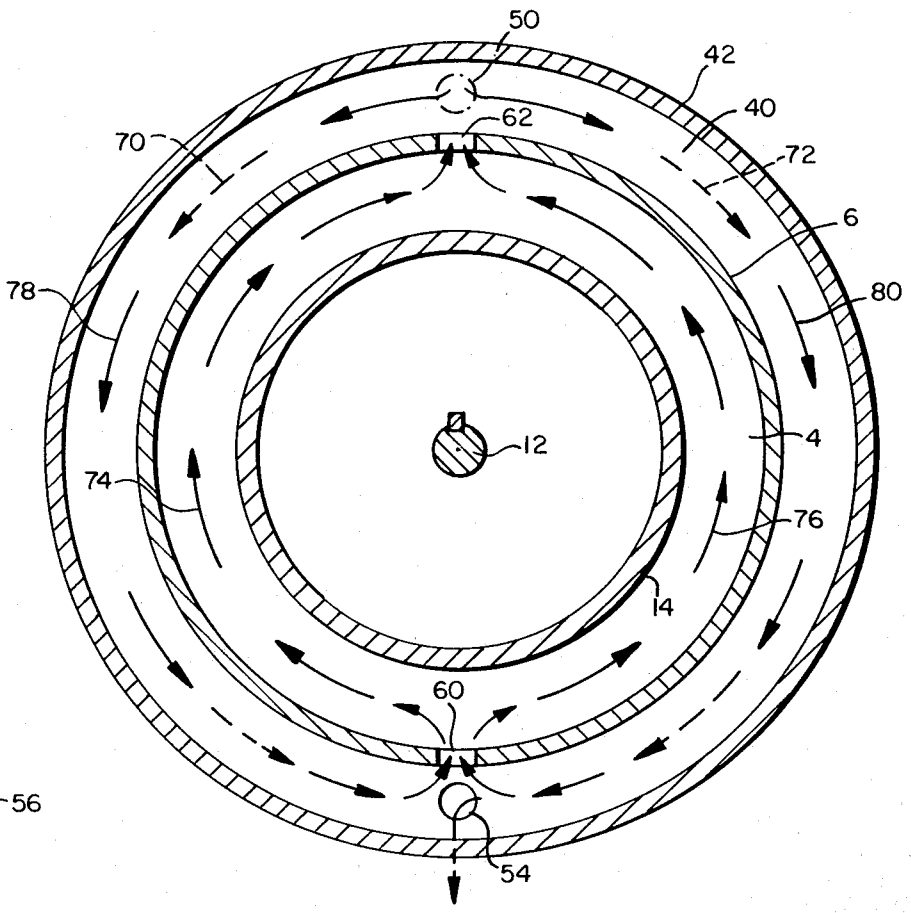
FIG. 2 is a sectional view taken on line 2—2 of FIG. 1.
Figure 1:
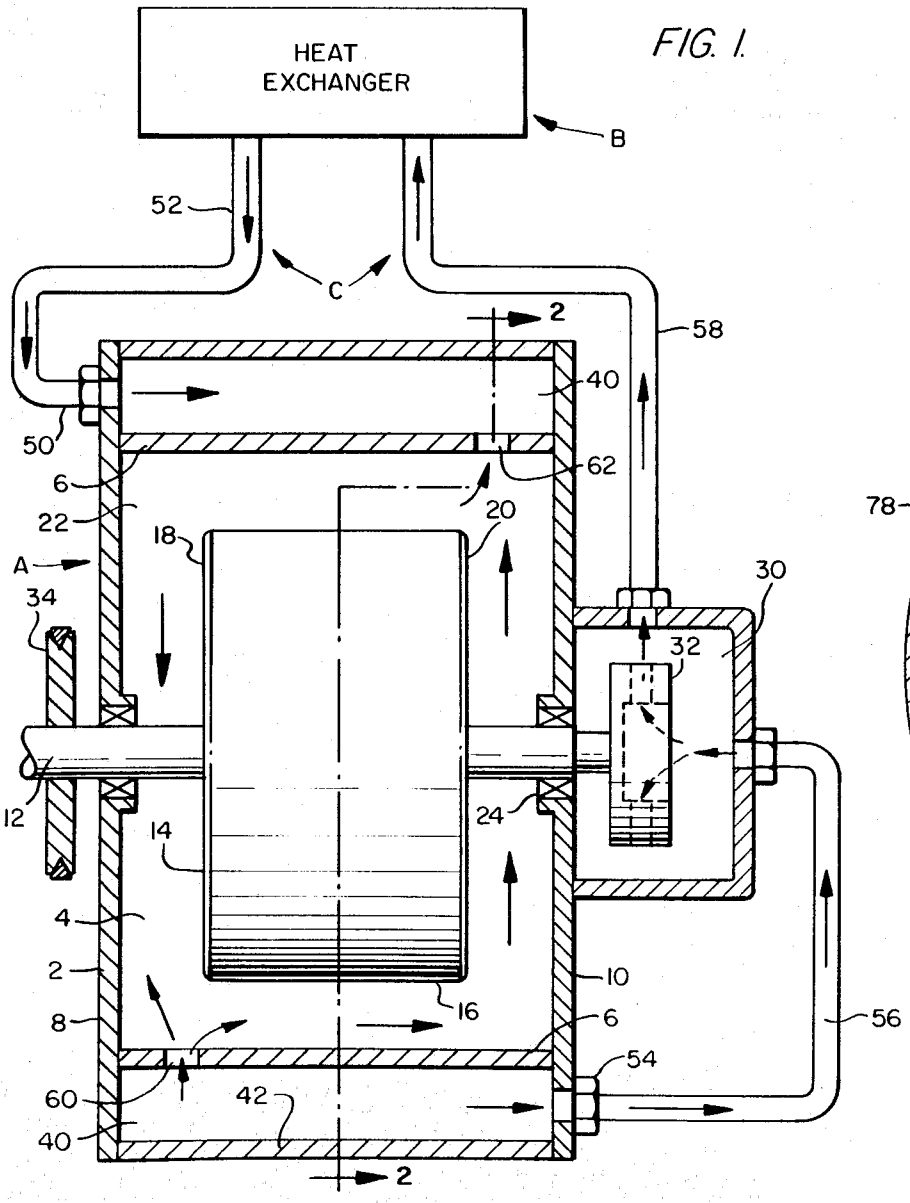
FIG. 1 is a part sectional and part schematic view of a heating system in accordance with the preferred embodiment of the invention.

The preferred embodiment of the heating system provided by the invention comprises a liquid heating unit A, a heat exchanger B, and tubing C which provides a system for circulating heated liquid from the liquid heating unit to the heat exchanger, where it loses heat, and back to the liquid heating unit for re-heating.

The basic liquid heating unit A comprises a housing 2 formed by a cylindrical wall 6 having a horixontal axis, and end walls 8, 10. These walls bound a rotor chamber within which there is mounted a shaft 12 a rotor 14 having a cylindrical surface 16 and, if desired, end walls 18, 20. The rotor surface is concentric with the cylindrical housing wall 6 and is spaced inwardly from it, leaving an annular space 22 within the housing and surrounding the rotor.

The shaft 12 is rotatably mounted in the end walls of the housing and extends outside the rotor chamber through a sealed bearing 24 in end wall 10 into a pump chamber 30 where a centrifugal type pump 32 is mounted on the shaft. Means are provided for rotating the shaft, the rotor and the pump and may take the form of a pulley and belt 34 which are connected to be driven by a motor (not shown).

The heat exchanger B is of conventional construction and comprises a screen through which a tube extends which, in accordance with known practice, is formed into a plurality of parallel sections connected by bends to provide a continuous conduit within the screen to which heated liquid is supplied from the liquid heater A and from which cooled liquid flows to the liquid heater.

Means are provided by the invention for pre-heating the cooled liquid flowing from the heat exchanger before it is introduced into the rotor chamber of the liquid heater, and such means comprise, first, an annular jacket chamber 40 which surrounds the rotor chamber 22 and is bounded on the outside by a cylindrical outer wall 42 and internally by the annular wall 6 of the rotor chamber. The radial width of the jacket chamber may be selected to provide a total volume of the system (rotor chamber, pump chamber, heat exchanger tubing and connecting tubing) adequate to produce sufficient liquid heated to a designed temperature to provide the BTUs required by the system.

In accordance with the invention the parts of the system are interconnected to produce a flow of liquid to cause the desired pre-heating of the liquid output of the heat exchanger. To provide this flow the upper part of the jacket chamber is connected at 50 to the tube 52 which is connected to the outlet end of the tubing of the heat exchanger, while the lower part of the jacket chamber is connected at 54 to the inlet end of the heat exchanger tubing through tube 56, pump chamber 30 and tube 58, which connects to the inlet of the heat exchanger tubing. The inlet and outlet connections 50, 54 between the jacket chamber and the heat exchanger are located at opposite axial ends of that chamber.

Internally of the apparatus the lower part of the jacket chamber communicates with the lower part of the rotor chamber through port 60 which is below the inlet opening 50 to the jacket chamber, and the upper part of the rotor chamber communicates with the upper part of the jacket chamber through port 62 which is above the outlet port 54 of the jacket chamber.

In the operation of the system cooled liquid flows from the heat exchanger through tube 52 and enters the jacket chamber 40 at port 50. Within the jacket chamber it flows downwardly in oppositely directed streams, as shown at 70, 72 in FIG. 2, to the lower part of the jacket chamber where it enters the rotor chamber through port 60. Within the rotor chamber the liquid flows upwardly in oppositely directed streams 74, 76 and is mixed with heated liquid being produced in the rotor chamber. The mixed heated liquid passes from the rotor chamber to the jacket chamber through port 62 which is above jacket chamber outlet port 54. Within the jacket chamber the heated liquid moves in oppositely and downwardly directed streams 78, 80 to the outlet port 54, from which it passes through tube 56, pump chamber 30 and tube 58 to the inlet port of the heat exchanger tubing.

The return flow of cooled liquid from the heat exchanger picks up heat in its passage through the jacket chamber by convection through the rotor chamber wall 6 and therefore enters the rotor chamber at a higher temperature than would be the case if the liquid stream flowing from the heat exchanger entered the rotor chamber directly, thus increasing the efficiency of the system.

The provision of the jacket chamber or its equivalent also permits the total volume of the system to be increased, this often being desirable or necessary to accomodate the heating unit to a particular installation.

I claim:

1. A heating system comprising:

(a) a heater for liquids comprising:

i. a housing having a chamber defined by a cylindrical wall having a horizontal axis, and end walls, ii. a shaft rotatably mounted co-axially within the housing chamber, iii. a rotor mounted on the shaft within the housing chamber and having a cylindrical external surface spaced inwardly from the cylindrical inner surface of the housing chamber thereby defining an annular space between the two cylindrical surfaces, iv. a pump chamber co-axial with the rotor chamber and having within it a pump mounted on the shaft, v. means for rotating the rotor and the pump, (b) a cylindrical wall surrounding and spaced from the cylindrical wall of the rotor chamber and defining a cylindrical jacket chamber surrounding the rotor chamber having inlet and outlet ports which are, respectively, at the upper and lower parts and at axially opposite ends of the jacket chamber, (c) a heat exchanger external to the liquid heater and having inlet and outlet ports, (d) tubing connecting the outlet port of the heat exchanger tubing to the jacket chamber inlet port, (e) tubing connecting the outlet port of the jacket chamber to the inlet port of the heat exchanger tubing, (f) a port connecting the rotor and jacket chambers which is positioned beneath the jacket chamber inlet port, and (g) a second port connecting the rotor and jacket chambers which is positioned above the jacket chamber outlet port.

2. A heating system comprising:

(a) a heater for liquids comprising:

i. a housing having a chamber defined by a cylindrical wall having a horizontal axis, and end walls, ii. a shaft rotatably mounted co-axially within the housing chamber, iii. a rotor mounted on the shaft within the housing chamber and having a cylindrical external surface spaced inwardly from the cylindrical inner surface of the housing chamber thereby defining an annular space between the two cylindrical surfaces, iv. a pump chamber co-axial with the rotor chamber and having within it a pump mounted on the shaft, v. means for rotating the rotor and the pump, (b) a cylindrical wall surrounding and spaced from the cylindrical wall of the rotor chamber and defining a cylindrical jacket chamber surrounding the rotor chamber, (c) a heat exchanger external to the liquid heater and having inlet and outlet ports, and a closed circuit formed by fluid conducting connections between the heat exchanger, the jacket chamber, the rotor chamber and the pump chamber for causing liquid to flow from the outlet port of the heat exchanger to the upper part of the jacket chamber, downwardly within the jacket chamber, upwardly into the rotor chamber, into the upper part of the jacket chamber, downwardly within the jacket chamber, from the lower part of the jacket chamber into the pump chamber, and from the pump chamber to the inlet port of the heat exchanger.

* * * * *